US006378719B1

(12) United States Patent
Kaiser

(10) Patent No.: US 6,378,719 B1
(45) Date of Patent: Apr. 30, 2002

(54) HOUSING FOR LIQUID CONTAINER

(76) Inventor: David M. Kaiser, 1580 Keel Dr., Howell, MI (US) 48843

( * ) Notice: Subject to any disclaimer, the term of this patent is extended or adjusted under 35 U.S.C. 154(b) by 0 days.

(21) Appl. No.: 09/578,254

(22) Filed: May 24, 2000

(51) Int. Cl.[7] ..... B65D 25/22
(52) U.S. Cl. ..... 220/475; 220/592.18; 220/4.22
(58) Field of Search ..... 220/475, 4.22, 220/592.18

(56) References Cited

U.S. PATENT DOCUMENTS

| | | | | | |
|---|---|---|---|---|---|
| 340,409 | A | | 4/1886 | Albaugh et al. | |
| 551,860 | A | | 12/1895 | Hale | |
| 2,090,668 | A | * | 8/1937 | Deutsch | 220/592.18 |
| 2,613,010 | A | * | 10/1952 | Atkinson | 220/475 |
| 2,624,451 | A | * | 1/1953 | Ewing | 220/592.18 |
| 2,716,508 | A | * | 8/1955 | Booth | 220/592.18 |
| 3,154,211 | A | * | 10/1964 | Bobowski | 220/475 |
| 3,235,212 | A | * | 2/1966 | Baumiller, Jr. | 220/475 |
| 3,908,853 | A | * | 9/1975 | Keesling | 220/475 |
| 4,757,920 | A | * | 7/1988 | Harootian, Jr. et al. | 220/4.22 |
| 5,183,182 | A | | 2/1993 | Comstock et al. | 222/129 |
| 5,607,085 | A | | 3/1997 | Cooper | 222/153.03 |
| 5,673,825 | A | | 10/1997 | Chen | 222/646 |
| 5,934,499 | A | * | 8/1999 | Van Der Hoven | 220/475 |
| 5,947,338 | A | | 9/1999 | Budsworth et al. | 222/181.3 |
| 6,019,238 | A | * | 2/2000 | Kindig et al. | 220/4.22 |

FOREIGN PATENT DOCUMENTS

| | | | | |
|---|---|---|---|---|
| CH | 384462 | * | 5/1964 | 220/475 |

* cited by examiner

*Primary Examiner*—Joseph M. Moy
(74) *Attorney, Agent, or Firm*—Bliss McGlynn & Nolan, PC

(57) ABSTRACT

A liquid-container housing for receiving, supporting, protecting, and securing a liquid container, which has a spigot adapted to allow a user access to the liquid within the container. The housing is adapted to be fixedly mounted upon a vertically extending support structure and includes a base and a lid having a double-wall construction. The base and lid combine to define four side walls, a bottom wall, and a top wall and expose the spigot for access by the user to the liquid in the container. At least one of the group including the four side walls and the top wall is rotatable about an axis defined by a hinge formed on the housing to define a closable opening to the housing such that the housing is adapted to receive, support, protect, and secure the liquid container and facilitate the insertion and removal of the liquid container. A boss depends from the base and is adapted to accommodate the support structure so as to fixedly mount the housing to the support structure.

20 Claims, 4 Drawing Sheets

HOUSING FOR LIQUID CONTAINER

BACKGROUND OF THE INVENTION

1. Field of the Invention

The present invention relates, generally, to housings for liquid containers and, more specifically, to liquid-container housings of the type supported by a stand and generally used to house an insulated cooler such as found on golf courses, parks, and other recreational areas.

2. Description of the Related Art

Liquid containers, such as water coolers, are often employed at outdoor recreational events and sporting environments, such as golf courses, parks, and recreational areas of all types. The coolers are typically strategically placed at tees and greens, along park paths, or in pavilions to provide a source of liquid refreshment. The containers are insulated and, most often, filled with water. Presently, one of the most common liquid containers employed for this purpose is a ten-gallon insulated cooler. The ten-gallon cooler is often cylindrical in shape with a spigot located at the lower end thereof. One such cooler in popular use today is manufactured by Igloo. However, it will be apparent from the detailed description that follows that the present invention is in no way limited to the size, manufacturer, or contents of the liquid containers.

Liquid containers such as the coolers used for the purposes alluded to above are often supported by a stand. Further, these stands will most often include a housing of some type that forms a partial or complete enclosure of the cooler. The coolers are supported within the enclosure defined by the housing so that the cooler spigot is accessible to a user. Further, the coolers are most often secured to the stand or housing by a lock-and-chain arrangement.

Stands of the type discussed above are usually portable. While portability adds a certain amount of convenience to this arrangement, it also makes the stand (and, thus, the cooler supported thereby) susceptible to theft. Accordingly, the stand is often chained to some other fixed structure. This deficiency inherently limits the placement of a stand where security is an issue. In addition, the presence of chains to secure equipment located on a golf course, for example, tends to negatively affect the overall ambience associated with the sport. Furthermore, the cooler stands presently available in the related art are relatively expensive.

This lastly stated fact has motivated some to build their own cooler stands. Most often, a wooden shed-like enclosure is constructed to house the cooler. However, homemade water-cooler sheds often suffer from the same deficiencies as cooler stands presently available in the related art. For example, the homemade sheds are also not without their costs. Lumber, paint, tools, and the cost of labor required to build such cooler sheds often make pre-manufactured cooler stands attractive, despite the expenses for such devices explained above. In addition, homemade cooler sheds are usually portable, which also makes them subject to security issues. Like in the case of pre-manufactured cooler stands, security for homemade stands is also typically addressed using chains and locks.

In addition, because homemade sheds are usually made of wood, they are subject to maintenance. More specifically, the sheds rot, chip, or peel, and sometimes various parts and other hardware can come loose or fall off the shed. Furthermore, discoloration due to weathering can leave the shed with a displeasing appearance. Accordingly, a significant amount of time and energy must be allocated for repairing and replacing these housings on a periodic basis.

Thus, there remains a need in the art for liquid-container housings that are durable, maintenance-free, and weather-resistant while providing good insulating properties and, most importantly, adequate security, not only for the housing itself, but for the cooler container within. Furthermore, there remains a need in the art for such a housing that is cost-effective, lightweight, long-lasting, and weatherproof. In addition, there remains a need in the art for such a housing that permits quick and easy installation, comprises few parts, has easy access for loading and unloading the containers, and is also adapted to present a supply of cups.

SUMMARY OF THE INVENTION

The present invention overcomes the deficiencies in the related art in a liquid-container housing for receiving, supporting, protecting, and securing a liquid container, which has a spigot adapted to allow a user access to the liquid within the container. The housing is adapted to be fixedly mounted upon a vertically extending support structure and includes a base and a lid having a double-wall construction. The base and lid combine to define four side walls, a bottom wall, and a top wall and expose the spigot for access by the user to the liquid in the container. At least one of the group including the four side walls and the top wall is rotatable about an axis defined by a hinge formed on the housing to define a closable opening to the housing such that the housing is adapted to receive, support, protect, and secure the liquid container and facilitate the insertion and removal of the liquid container. A boss depends from the base and is adapted to accommodate the support structure so as to fixedly mount the housing to the support structure.

Accordingly, one advantage of the liquid-container housing of the present invention is that it is durable and maintenance-free.

Another advantage of the liquid-container housing of the present invention is that it is weather-resistant and weather-proof and resists fading.

Another advantage of the liquid-container housing of the present invention is that it provides good insulating properties.

Another advantage of the liquid-container housing of the present invention is that it provides adequate security for the housing and the liquid container therewithin.

Another advantage of the liquid-container housing of the present invention is that it is lightweight, long-lasting, and cost-effective.

Still, another advantage of the liquid-container housing of the present invention is that it permits quick and easy installation.

Still, another advantage of the liquid-container housing of the present invention is that it comprises few parts.

Finally, another advantage of the liquid-container housing of the present invention is that it has easy access for loading and unloading the liquid containers.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figure 2:
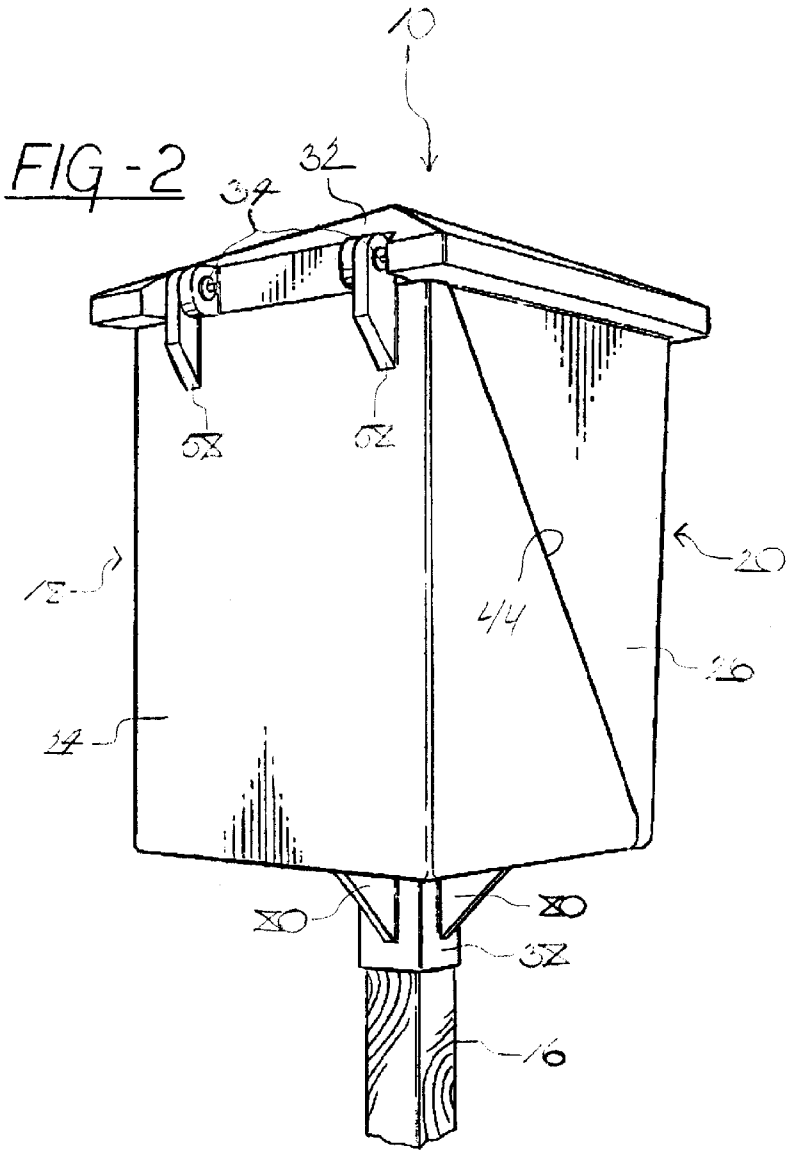
FIG. 2 is a rear perspective view of the liquid-container housing of the present invention in the closed position.

One preferred embodiment of a liquid-container housing of the present invention is generally indicated at 10 throughout the figures, where like numerals are used to describe like structure. As will be clear from the following discussion, the housing 10 is adapted for receiving, supporting, protecting, and securing a liquid container 12, which has a spigot 14 adapted to allow a user access to the liquid within the container 12. The container 12 may be of any suitable type commercially available and well-known in the art. Thus, neither the container 12 nor the contents thereof form any part of the present invention. In the preferred embodiment illustrated in these figures, the housing 10 is adapted to be fixedly mounted upon a vertically extending support structure 16, such as an upright post, that may be permanently mounted, for example, by cementing the support structure 16 in the ground. Alternatively, the support structure 16 may be removably, but securely, mounted to another fixed structure via lag bolts, mounting plates, or the like. Similarly, the housing 10 may be permanently or removably mounted to the support structure 16.

As shown in the figures, the housing 10 includes a base, generally indicated at 18, and a lid, generally indicated at 20. The base and lid 18,20 have a double-wall construction for added strength while still retaining relatively light weight. The double-wall construction is best illustrated from the bottom view of FIG. 5 and the phantom lines in FIG. 7. The base and lid 18,20 combine to define four side walls 22,24, 26,28, a bottom wall 30, and a top wall 32. The base and lid 18,20 also combine to expose the spigot 14 for access by the user to the liquid in the container 12. As will be described in greater detail below, at least one of the group including the four side walls 22,24,26,28 and the top wall 32 is rotatable about an axis defined by a hinge 34 formed on the housing 10 to define a closable opening 36 (FIG. 7) to the housing 10 such that the housing 10 is adapted to receive, support, protect, and secure the liquid container 12 and facilitate the insertion and removal of the liquid container 12.

Furthermore, as shown throughout the figures, the top wall 32 of the lid 20 defines a roof of the housing 10 and is of a substantially pyramidal shape. The pyramidally shaped roof facilitates the effective shedding of rainwater and the like. However, the housing 10 may be manufactured without a pyramidally shaped roof.

Discounting the pyramidally shaped roof illustrated in the figures, the housing 10 is of a substantially cubical shape. However, those having ordinary skill in the art will appreciate that the housing 10 could take the form of a rectangular hexahedron, a cylinder, or any other geometric shape. The housing 10 is preferably manufactured by a rotational-molding procedure from high-impact, resistant, linear, low-density polyethylene having ultra-violet protection and anti-fade inhibitors.

As illustrated throughout the figures, walls 22 and 24 define the front and rear, respectively, of the housing 10 while walls 26 and 28 define the sides of the housing 10. The lid 20 includes the front wall 22, and the base 18 includes the rear wall 24. As best shown in FIGS. 1, 3, 3A, and 6, the housing 10 also includes a spigot opening 82 formed in the front wall 22 of the lid 18. The opening 82 is adapted to accommodate the spigot 14 on the container 12 for access by the user. The base 18 and the lid 20 combine to form a clamshell-like configuration wherein the lid 20 is adapted to be opened and closed relative to the base 20 for insertion, reception, support, protection, security, and removal of the liquid container 12, as will be explained in greater detail below.

Figure 1:
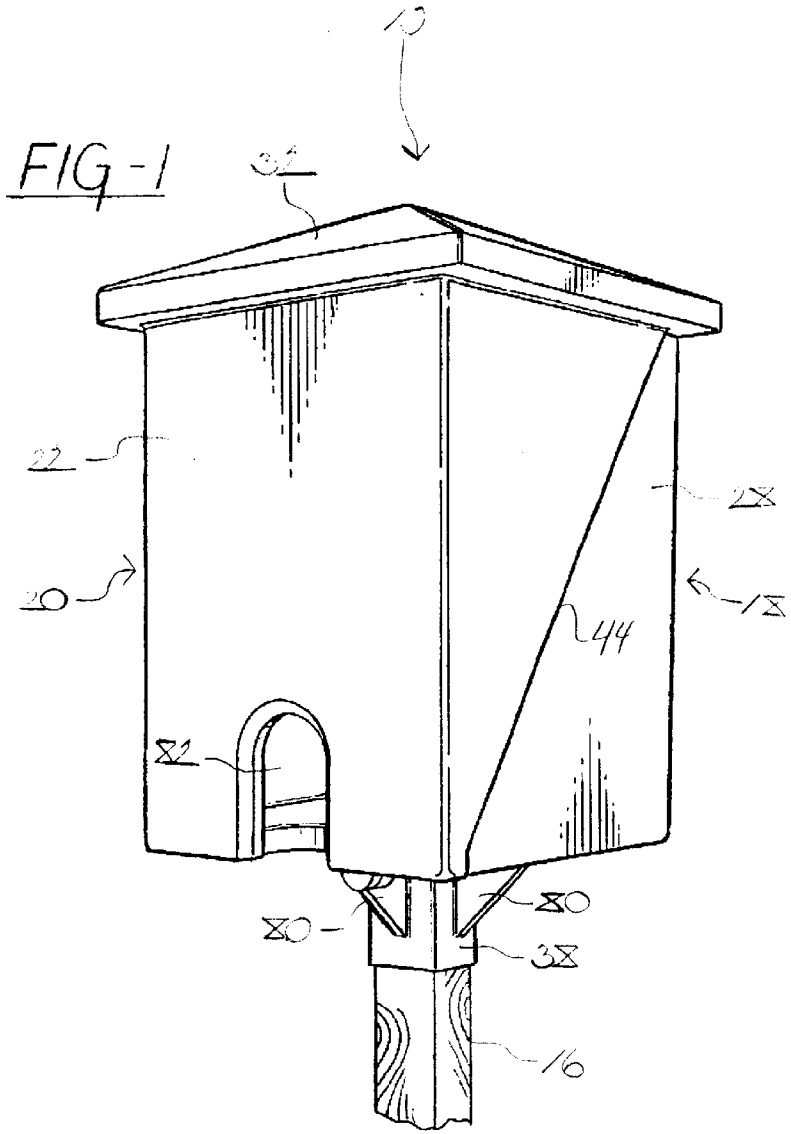
FIG. 1 is a front perspective view of the liquid-container housing of the present invention in the closed position.
Figure 3:
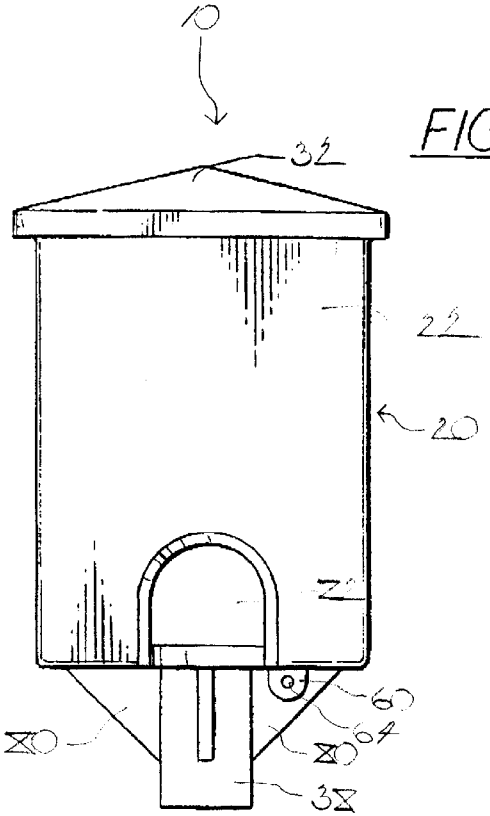
FIG. 3 is front view of the liquid-container housing of the present invention in the closed position.
Figure 3A:
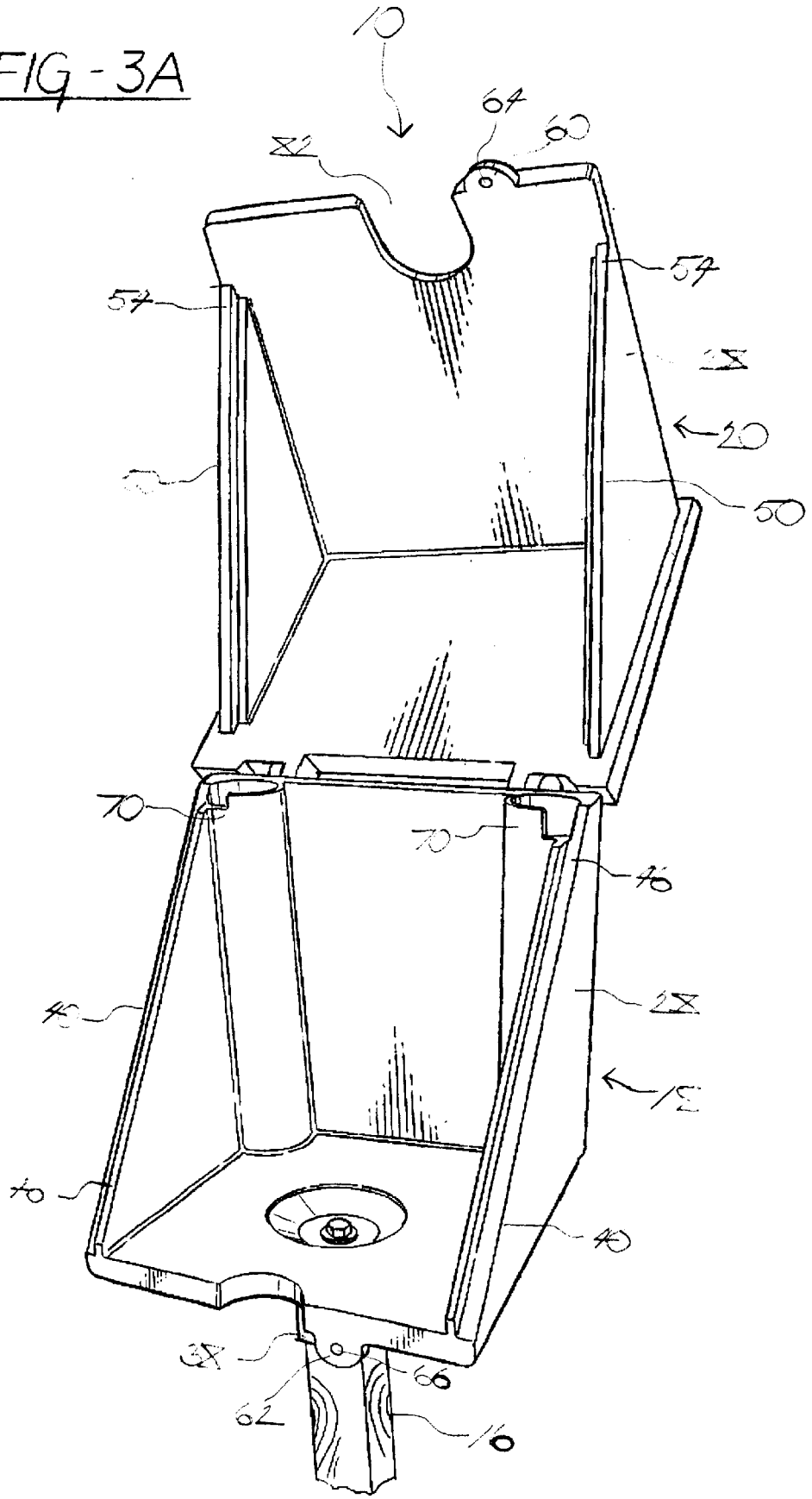
FIG. 3A is a front perspective view of the liquid-container housing of the present invention in the opened position.
Figure 6:
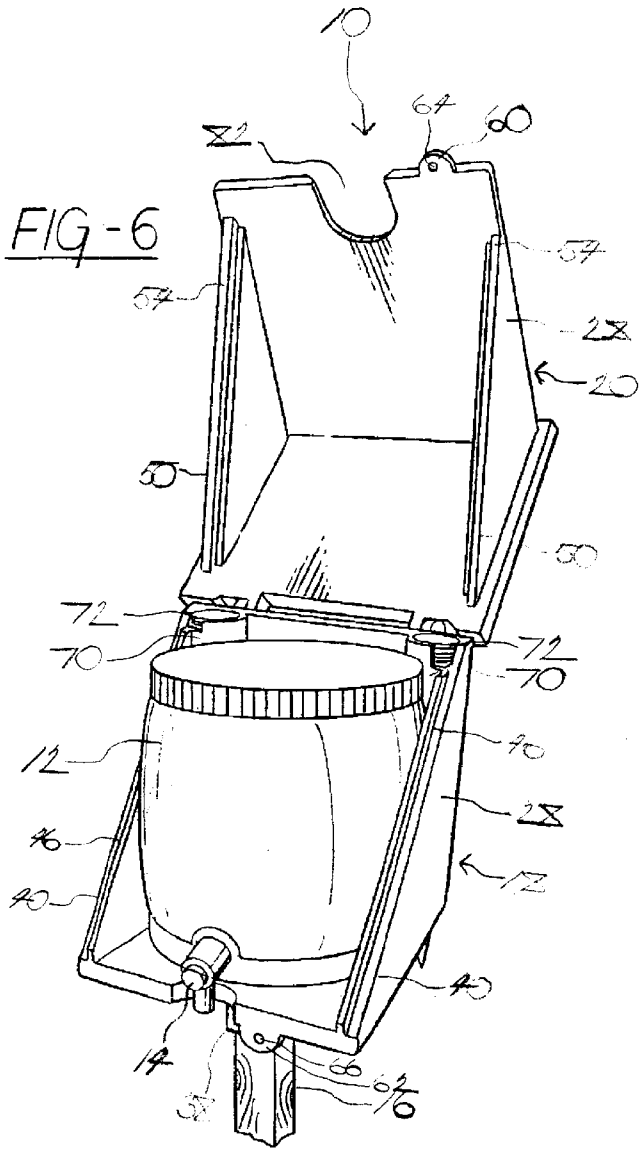
FIG. 6 is a front perspective view of the liquid-container housing of the present invention in the opened position supporting a liquid container.

Specifically, as best shown in FIGS. 3A and 6, the base 18 includes at least two side walls 40 that are bisected along a diagonal 44, which is best shown in FIGS. 1 and 2, to define lower mating surfaces 46. The lid 20, too, includes at least two side walls 50 that are bisected along the diagonal 44 to define upper mating surfaces 54 that are adapted to cooperatively abut the lower mating surfaces 46 when the opening 36 to the housing 10 is closed. In the preferred embodiment, the upper and lower mating surfaces 46 and 54, respectively, may engage each other in a tongue-and-groove arrangement or any other suitable structure.

Figure 4:
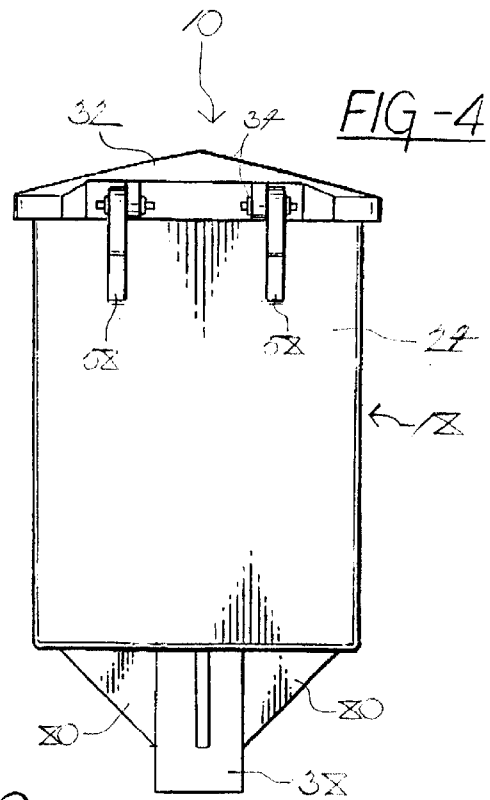
FIG. 4 is a rear view of the liquid-container housing of the present invention in the closed position.
Figure 7:
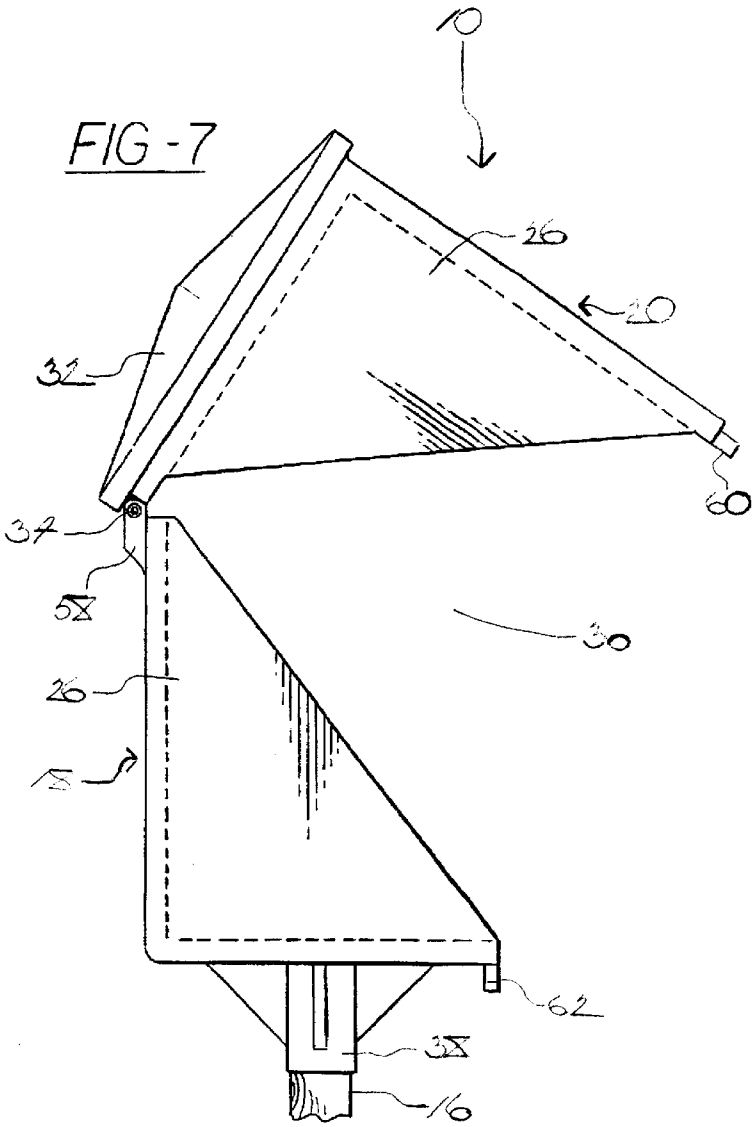
FIG. 7 is a side view of the liquid-container housing of the present invention in the opened position.

Also, as best shown in FIGS. 2, 4, and 7, the hinge 34 is disposed at the upper margin of at least one of the four side walls 22,24,26,28 with the lid 20 supported upon the base 18 for rotation about the axis defined by the hinge 34. In the preferred embodiment, the hinge 34 is disposed at the upper interior margin of the rear wall 24. However, those having ordinary skill in the art will appreciate that the hinge 34 may be located either on the interior or exterior of any of the walls 22,24,26,28. Furthermore, to facilitate the convenient use of the housing 10, the housing 10 may also include a stop wedge 58 located, for example, at the upper exterior margin of the rear wall 24 to limit the rotation of the lid 20 about the axis of the hinge 34.

As best shown in FIGS. 3, 3A, 5, 6, and 7, the housing 10 further includes a flange 60 depending from the lid 20 and a flange 62 depending from the base 18.

Each of the flanges 60,62 has an aperture 64,66, respectively, through the flange 60,62 and is adapted to be in abutting contact with the other of the flanges 60,62 when the lid 20 is closed relative to the base 18 such that the apertures 64,66 are suitably aligned so as to be coaxial and adapted to readily accommodate a locking mechanism, like a padlock (not shown). In this way, the liquid container 12 may be securely supported within the housing 10. Flange 60 also is adapted to act as a handle for opening and closing the lid 20 relative to the base 18.

Figure 5:
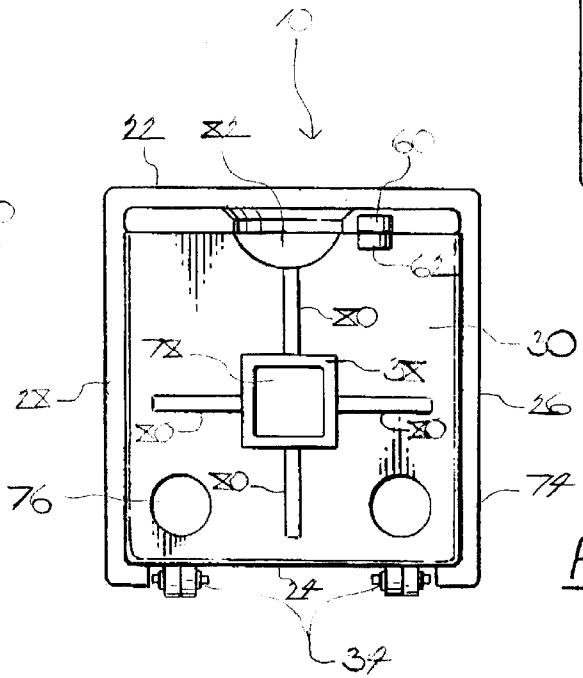
FIG. 5 is a bottom view of the liquid-container housing of the present invention in the closed position.

As best shown in FIGS. 3A, 5, and 6, the housing 10 further includes at least one sleeve 70 adapted to support a plurality of cups 72 supplied to receive the liquid that is dispensed from the liquid container 12. In particular, the housing 10 includes a pair of vertically extending, circularly shaped, upwardly opening sleeves 70 disposed at the interior rear corners of the base 18. The bottom wall 30 includes a pair of orifices 74 concentric with the pair of sleeves 70 and adapted to accommodate dispensing of the cups 72.

As noted above, the housing 10 is adapted to be supported upon a vertically extending structure 16, such as a post, that may be fixedly mounted to the ground. A boss 38 depends from the base 18 and is adapted to accommodate the support structure 16 so as to fixedly mount the housing 10 to the support structure 16. To this end and as best shown in FIG. 5, the boss 38 has a substantially rectangular shape and defines a channel 78 that is aligned or at least substantially parallel with the upright vertical axis of the housing 10. The channel 78 is adapted to receive the support structure 16 so as to fixedly mount the housing 10 to the support structure 16. As presently contemplated, the support structure 16 would most probably be a 4×4 or 4×6 wooden post cemented into the ground or otherwise immovably secured in place. The base 18 includes the bottom wall 30, with which the boss 38 is integrally formed, and at least two, but preferably four, flanges 80 extending between the boss 38 and the bottom wall 30 so as to strengthen the boss 38. The four flanges 80 are of a substantially triangular shape and disposed at substantially right angles to each other.

In operation and when fixedly mounted to the support structure 16, the housing 10 is adapted to receive and securely house a container 12, for example, a ten-gallon-capacity cooler, that is supported within the enclosure defined by the housing 10. More specifically, the lid 20 is rotated about the axis of the hinge 34 from a closed position, illustrated in FIGS. 1, 2, 3, and 4, to an opened position, representatively illustrated in FIGS. 3A, 6, and 7. However, those having ordinary skill in the art will appreciate that the lid 20 may rotate farther about the axis of the hinge 34 and that the opened position of the lid 20 is in no way limited to the position of the lid 20 shown in FIGS. 3A, 6, and 7. The container 12 is then placed within the opening 36 defined by the housing 10 such that the spigot 14 of the container 12 is in registration with the opening 82 formed in the front wall 22 of the lid 20. The lid 20 is then again rotated about the axis of the hinge 34 to the closed position of the lid 20. The container 12 is secured within the housing 10 by use, for example, of a bar of a padlock that extends through the apertures 64,66 of the corresponding mating flanges 60,62 on the lid 20 and the base 18, respectively.

The housing 10 is durable, maintenance-free, weatherproof and -resistant, lightweight, long-lasting, cost-effective, and easy to install. No painting is required because the housing 10 is manufactured using a UV-protected plastic resin in pleasant colors with anti-fade inhibitors. Also, the housing 10 provides good insulating properties and adequate security for the housing 10 and the liquid container 12 therewithin. In addition, the housing 10 has easy access for loading and unloading the liquid containers and comprises few parts and no hardware that eventually loosens or corrodes. Lastly, the housing 10 will not rot or fade. Thus, the housing 10 of the present invention requires essentially no maintenance over its relatively indefinite lifetime.

The invention has been described in an illustrative manner. It is to be understood that the terminology that has been used is intended to be in the nature of words of description rather than of limitation. Many modifications and variations of the invention are possible in light of the above teachings. Therefore, the invention may be practiced other than as specifically described.

I claim:

1. A housing for receiving, supporting, protecting, and securing a liquid container and adapted to be fixedly mounted upon a vertically extending support structure, the liquid container having a spigot adapted to allow a user access to the liquid within the container, said housing comprising:

a base and a lid, said base and lid having a double-wall construction so as to define an inner wall spaced from an outer wall and combining to define four side walls, a bottom wall, and a top wall and exposing the spigot for access by the user to the liquid in the container;

at least one of the group including said four side walls and said top wall being rotatable about an axis defined by a hinge formed on said housing to define a closable opening to said housing such that said housing is adapted to receive, support, protect, and secure the liquid container and facilitate the insertion and removal of the liquid container; and a boss depending from said base and adapted to accommodate the support structure so as to fixedly mount said housing to the support structure, said boss being integrally formed with said bottom wall of said housing and defining a channel that is adapted to receive the support structure so as to fixedly mount said housing to the support structure and wherein said base further includes at least two flanges extending between said boss and the bottom of said base so as to strengthen said boss.

2. A housing as set forth in claim 1, wherein said hinge is disposed at the upper margin of at least one of said four side walls with said lid supported upon said base for rotation about said axis defined by said hinge and with said base and said lid combining to form a clamshell-like configuration wherein said lid is adapted to be opened and closed relative to said base for insertion, reception, support, protection, security, and removal of the liquid container.

3. A housing as set forth in claim 2, wherein said base includes at least two side walls that are bisected along a diagonal to define lower mating surfaces and said lid includes at least two side walls that are bisected along a diagonal to define upper mating surfaces that are adapted to cooperatively abut said lower mating surfaces when the opening to said housing is closed.

4. A housing as set forth in claim 3, wherein said lid includes a front side-wall and said base includes a rear side-wall, said hinge disposed at the upper interior margin of said rear side-wall.

5. A housing as set forth in claim 4, wherein said rear side-wall includes a stop wedge disposed at the upper exterior margin of said rear side-wall and acts to limit the rotation of said lid about said axis of said hinge.

6. A housing as set forth in claim 1, wherein said housing further includes a handle operatively attached to said lid for opening and closing said lid relative to said base.

7. A housing as set forth in claim 1, wherein said housing further includes a flange depending from said lid and a flange depending from said base, each of said flanges having an aperture therethrough and adapted to be in abutting contact with the other of said flanges when said lid is closed relative to said base such that said apertures are suitably aligned so as to be coaxial and adapted to readily accommodate a locking mechanism such that the liquid container may be securely supported within said housing.

8. A housing as set forth in claim 1, wherein said top wall of said lid defines a roof of said housing.

9. A housing as set forth in claim 8, wherein said roof is of a substantially pyramidal shape.

10. A housing as set forth in claim 1, wherein said housing further includes at least one sleeve adapted to support a plurality of cups to receive the liquid that is dispensed from said liquid container.

11. A housing as set forth in claim 10, wherein said at least one sleeve consists of a pair of vertically extending, circularly shaped, upwardly opening sleeves disposed at the interior rear corners of said base.

12. A housing as set forth in claim 11, wherein said bottom wall includes a pair of orifices concentric with said pair of sleeves and adapted to accommodate dispensing of cups.

13. A housing as set forth in claim 1, wherein said at least two flanges are of a substantially triangular shape.

14. A housing as set forth in claim 1, wherein said base includes four flanges extending between said boss and the bottom of said base so as to strengthen said boss.

15. A housing as set forth in claim 14, wherein adjacent ones of said four flanges are disposed at substantially right angles to each other.

16. A housing as set forth in claim 1, wherein said channel in said boss is of a substantially rectangular shape.

17. A housing as set forth in claim 1, wherein said housing is manufactured from high-impact, resistant, linear, low-density polyethylene having ultra-violet protection and anti-fade inhibitors.

18. A housing as set forth in claim 17, wherein said housing is manufactured by a rotational-molding procedure.

19. A housing for receiving, supporting, protecting, and securing a liquid container and adapted to be fixedly mounted upon a vertically extending support structure, the liquid container having a spigot adapted to allow a user access to the liquid within the container, said housing comprising:

a base and a lid, said base and lid having a double-wall construction and combining to define four side walls, a bottom wall, and a top wall and exposing the spigot for access by the user to the liquid in the container;

at least one of the group including said four side walls and said top wall being rotatable about an axis defined by a hinge formed on said housing to define a closable opening to said housing such that said housing is adapted to receive, support, protect, and secure the liquid container and facilitate the insertion and removal of the liquid container;

at least one sleeve adapted to support a plurality of cups to receive the liquid that is dispensed from said liquid container; and a boss depending from said base and adapted to accommodate the support structure so as to fixedly mount said housing to the support structure, said boss being integrally formed with said bottom wall of said housing and defining a channel that is adapted to receive the support structure so as to fixedly mount said housing to the support structure and wherein said base further includes at least two flanges extending between said boss and the bottom of said base so as to strengthen said boss.

20. A housing as set forth in claim 1, wherein said housing is of a substantially cubical shape.

* * * * *